United States Patent [19]

Tsuchiya

[11] Patent Number: 4,565,076

[45] Date of Patent: Jan. 21, 1986

[54] SAFETY DEVICE FOR CIRCULAR KNITTING MACHINES

[75] Inventor: Koji Tsuchiya, Hyogo, Japan

[73] Assignee: Precision Fukuhara Works, Ltd., Kobe, Japan

[21] Appl. No.: 661,102

[22] Filed: Oct. 15, 1984

[30] Foreign Application Priority Data

Nov. 4, 1983 [JP] Japan ..... 58-171759

[51] Int. Cl.[4] ..... D04B 15/88; D04B 35/10

[52] U.S. Cl. ..... 66/151; 66/157; 66/166

[58] Field of Search ..... 66/151, 153, 157, 166

[56] References Cited

U.S. PATENT DOCUMENTS 2,003,774 6/1935 Gruna et al. ..... 66/166

2,932,182 4/1960 Lawson ..... 66/166 X

FOREIGN PATENT DOCUMENTS 88791 9/1896 Fed. Rep. of Germany ..... 66/166

*Primary Examiner*—Wm. Carter Reynolds

*Attorney, Agent, or Firm*—Nathan Levin

[57] ABSTRACT

A single safety device to automatically stop a conventional circular knitting machine in the event of failure of the belt used to drive a pair of fabric advancing rollers of the machine while the fabric is being knit, and/or to stop the machine in the event of failure to secure the so-advanced fabric to the rotary shaft upon which the fabric is normally rolled to sequentially form individual rolls of fabric on the machine.

6 Claims, 9 Drawing Figures

SAFETY DEVICE FOR CIRCULAR KNITTING MACHINES

Figure 1:
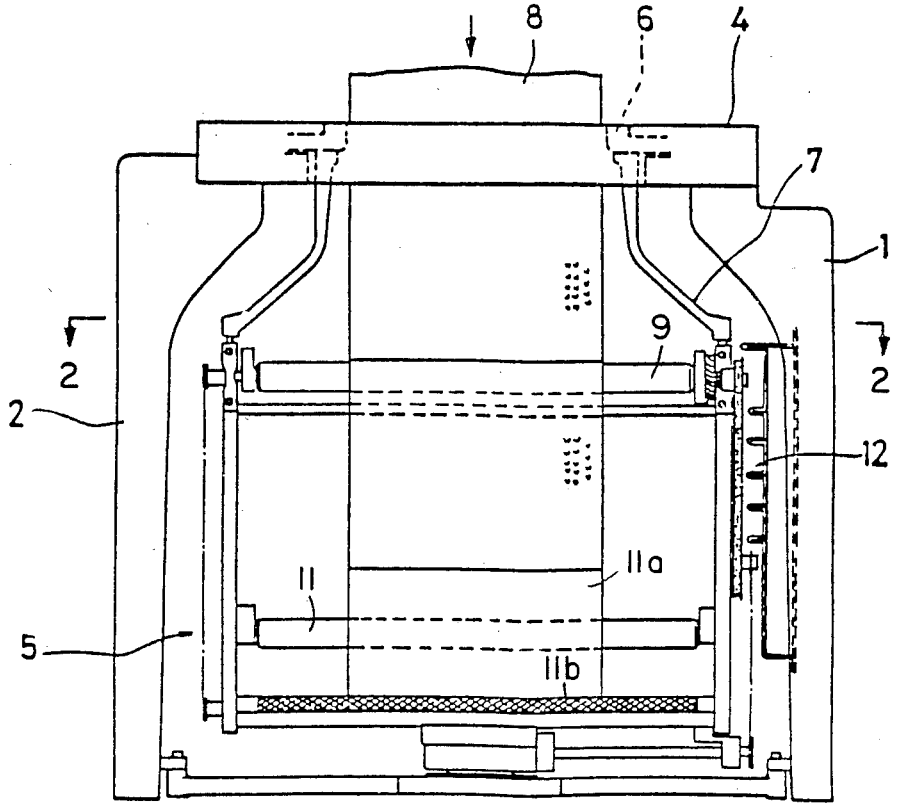

The present invention relates generally to the art of knitting and more particularly to circular knitting machines of the type having a fabric take-up to advance that fabric being knit by the machine and to sequentially form individual rolls of the so-advanced fabric. The fabric take-up includes a pair of rollers to advance the fabric and a rotary shaft upon which the rolls are formed.

The present invention provides a safety device to be used in combination with a machine of the type set forth to automatically stop the machine in the event that the rollers fail to advance the and/or in the event that the shaft fails to form the rolls of fabric thereon.

The fabric take-up of the above referred to circular knitting machine includes a pair of rollers which are driven via a driving belt and a belt pulley thereby to tension and to advance the fabric being knit. In the event of accidental breakage of the belt the rollers cease to turn and cease to advance the fabric. At the same time the rollers and the pulley of the take-up are moved to another position in which the safety device of the present invention is engaged by the pulley thereby to actuate the safety device to automatically stop the machine.

The fabric take-up of the machine also includes a rotary shaft upon which the individual rolls of the so-advanced fabric are sequentially formed. At the start of each roll of fabric a few turns thereof is hand wound upon the shaft to anchor the fabric thereon. The fabric normally extends under tension directly from the fabric rollers to the fabric shaft as it is being rolled up upon the shaft. The machine is stopped upon completion of each roll of fabric and the fabric is coursewise severed between the fabric rollers and the fabric shaft. The severed portion of the fabric extending from the rollers will be the starting portion of the next roll of fabric. The so-made roll of fabric with the fabric shaft therein is removed from the machine. The shaft is removed from the roll of fabric. The shaft is returned to the machine with a few turns of the starting portion of the fabric wound upon the shaft to secure the fabric thereto. The machine is re-started to make the next roll of fabric. However, in the event that the operator fails to secure the fabric to the shaft, or fails to do so in a proper manner, before re-starting the machine, the fabric will swing outwardly of the machine by centrifugal force. The swinging fabric will engage the safety device of the present invention to actuate the same to automatically stop the machine thereby to prevent damage to the machine by the swinging fabric.

It is the primary object of the present invention to provide a safety device for circular knitting machines to automatically stop the machine in the event that its fabric rollers cease the advance of the fabric being knit and/or in the event that its fabric take-up shaft fails to roll up the fabric thereon.

With the above and other objects in view as will become apparent from the accompanying drawings and the description thereof, the invention resides in the safety device for circular knitting machines as shown and as described and as set forth in the appended claims.

Figure 3:
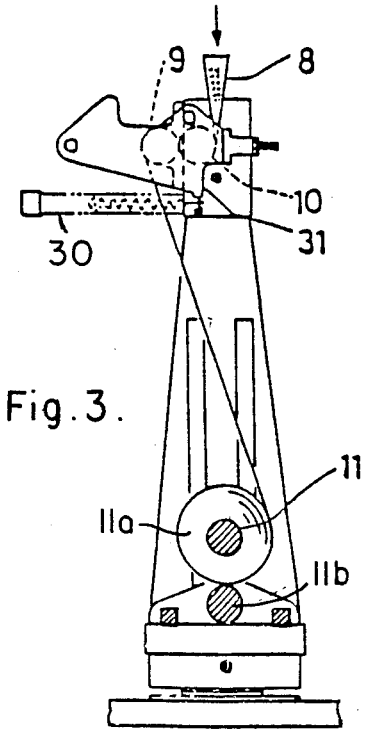
Figure 2:
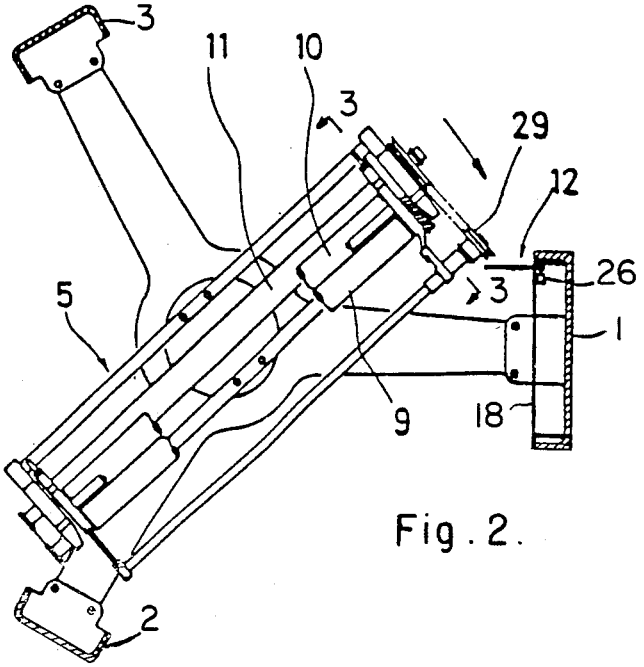
Figure 4:
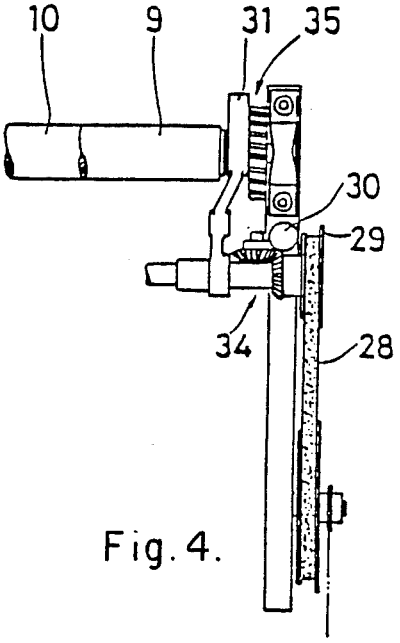
Figure 5:
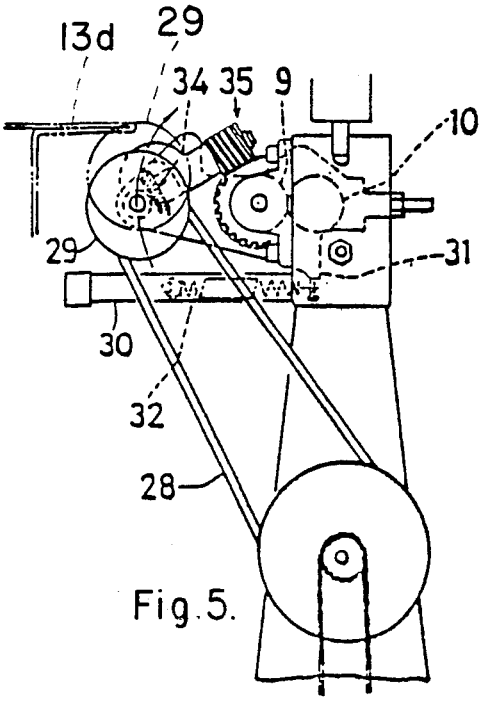
Figure 6:
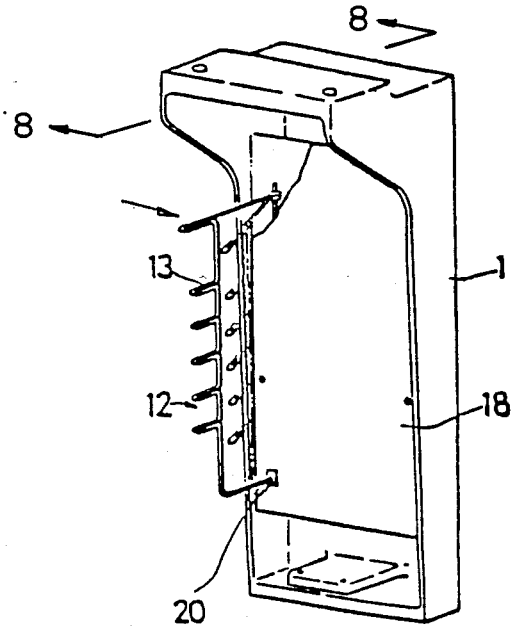
Figure 7:
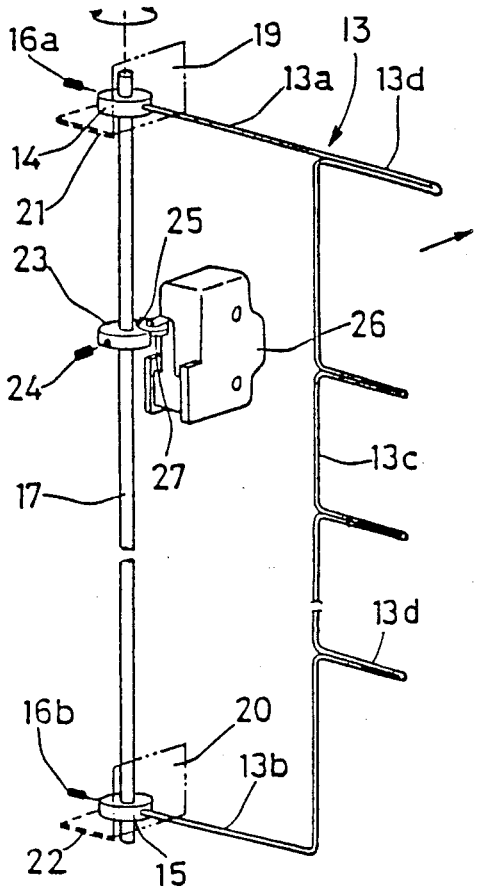
Figure 9:
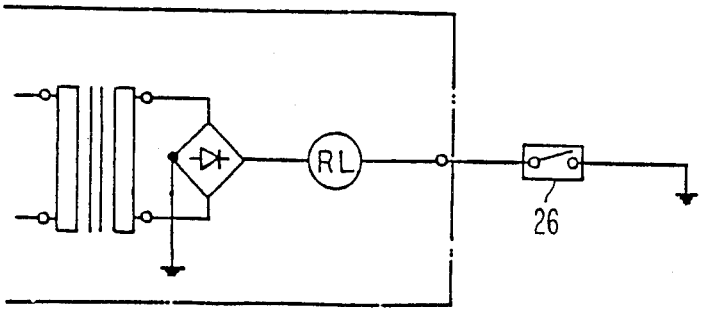
Figure 8:
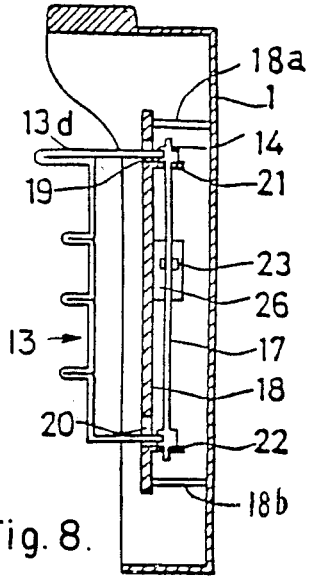

In the drawings:

FIG. 1 is a side elevational view of the lower part of a conventional rotary cylinder circular knitting machine including its take-up assembly and of the safety device in combination therewith, FIG. 2 is a plan view in section of FIG. 1 on line 2—2 thereof, FIG. 3 is a side elevational view in section of FIG. 2 on line 3—3 thereof, FIG. 4 is an enlarged view in detail of a portion of FIG. 1, FIG. 5 is a side elevational view of FIG. 4, FIG. 6 is a perspective view of the safety device of the present invention in position on the machine, FIG. 7 is a schematic view in perspective of the safety device itself, FIG. 8 is a vertical sectional view of FIG. 6 on line 8—8 thereof, and FIG. 9 is a view of the control circuit of the machine with the safety device of the present invention incorporated therein.

A conventional rotary cylinder circular knitting machine as shown in FIGS. 1 and 2 is provided with stationary spaced legs 1, 2 and 3 which support bed 4 of the machine. The legs are U-shaped in cross section with the open side of the U-shape facing the axis of the machine. The machine is provided with a take-up assembly 5 which rotates synchronously with a rotary gear ring 6 inside the bed and to which the assembly is connected to and is driven by arms 7. The machine forms fabric 8 which moves downwardly in the direction of the arrow in FIG. 1, the fabric passing around and under a roller 10, then upwardly between the rollers, and then around and downwardly over a roller 9 to the rotary fabric shaft 11 upon which the fabric is rolled to form rolls 11*a* thereon.

The machine is stopped when a roll 11*a* reaches a selected diameter. The fabric is then out coursewise between rollers 9, 10 and roll 11*a* and the roll with the shaft therein is removed from the machine. The shaft is removed from the roll. The shaft is replaced on the machine with a few turns of the starting portion of the next roll of fabric wound upon the shaft to secure the fabric thereto. The machine is then re-started. The shaft with the fabric thereon is frictionally driven by contact with a rotary shaft 11*b*. In this way individual rolls of the fabric are sequentially made upon the machine.

In the event that the machine operator fails to securely anchor the fabric to the rotary shaft before re-starting the machine, the free end of the fabric extending from rollers 9, 10 will swing outwardly of the machine by centrifugal force and the machine will be damaged thereby.

The safety device of the present invention, indicated generally at 12, will act to automatically stop the machine in the event that the fabric swings outwardly of the machine, and, in addition, will also act to automatically stop the machine in the event that rollers 9, 10 cease to advance the fabric.

The device is mounted upon a plate 18 which is secured within the U-shaped opening of leg 1 by a number of spaced supporting studs 18*a*, 18*b*. A pair of vertically spaced window openings 19, 20 is formed in the plate by bending sections 21, 22 thereof inwardly. A vertically extending shaft 17 is rotatably journalled in suitable openings in the sections 21, 22. The shaft is retained by disks 14, 15 which are adjustably secured to the shaft by set screws 16*a*, 16*b*. Also adjustably secured to shaft 17 by set screw 24 is a disk 23 having a cut out 25 therein and into which a roller 27 of a micro-switch 26 is normally seated. The switch 26 is secured to the inner face of plate 18. A comb-like wire detector has spaced parallel arms 13*a*, 13*b* the ends of which are anchored in disks 14, 15 and is provided with a number of horizontal spaced fingers 13*d* between vertical spacers 13*c*, the uppermost finger 13*d* being longer than the others thereof. The arrangement is such that oscillating movement of the detector 13 will cause shaft 17 to move accordingly about its axis, as shown by the arc shaped arrow in FIG. 7. Such movement of shaft 17 will turn disk 23 to act upon roller 27 to actuate the switch to stop the machine. The switch is in the circuit controlling the operation of the machine, FIG. 9.

In the event that the free end of the severed fabric is not secured in place upon the fabric shaft when the machine is re-started, it will swing outwardly and engage one or more of the fingers of the detector 13 thereby to actuate the safety device by turning the shaft 17 so that the micro-switch is actuated to stop the machine.

Referring now to FIGS. 4 and 5, the take-up rollers 9, 10 are conventionally driven via a belt 28 which drives a belt pulley 29, which drives bevel gears 34, which drives a worm and worm gear (the gear being fast to roller 9) to turn the rollers 9, 10. Pulley 29 is supported by a bracket 31 which is rotatably positioned upon one end of roller 9. A belt tensioning device 30 attached to bracket 31 has a spring 32 which serves to turn the bracket about the axis of roller 9 and to provide constant tension to belt 28.

In the event that belt 28 is accidentally broken while the maxhine is operating, belt pulley 29 will be lifted up to its dotted line position in FIG. 5 by spring 32 and by centrifugal force so that, as the machine rotates, pulley 29 will engage finger 13*d* of the safety device to turn the shaft 17 to operate the safety in the manner above set forth to automatically stop the machine. The fabric will cease to be advanced by rollers 9, 10 upon breakage of the driving belt.

It is to be noted, with respect to actuation of the safety device by the outwardly swinging fabric, that the present invention is particularly useful on modern machines operating at the higher speeds at which the centrifugal force acting upon the fabric is sufficiently large to swing the fabric outwardly to a position in which it operates the safety device.

I claim:

1. A safety device for use in combination with a conventional circular knitting machine of the type having driven rotary take-up rollers to engage with and to advance the fabric being knit by the machine, the machine also having a rotary shaft upon which the so-advanced fabric is secured to and is rolled up upon, the machine also having means to drive the take up rollers and to secure the fabric to the rotary shaft, the safety device operating in combination with the machine in such manner as to automatically stop the machine in the event of failure of the means to drive the take-up rollers with a resultant failure to advance the fabric, the safety device also operating in combination with the machine in such manner as to automatically stop the machine in the event of failure to secure the fabric to the rotary shaft.

2. A safety device as in claim 1 wherein the safety device comprises a single unit to automatically stop the machine in the event of failure to drive the take-up rollers or in the event of failure to secure the fabric to the shaft.

3. A safety device as in claim 1 wherein the means has a driving belt and a belt driven pulley to drive the take-up rollers, and wherein the pulley acts to engage the safety device to automatically stop the machine in the event of failure of the belt to drive the pulley.

4. A safety device for use in combination with a conventional circular knitting machine of the type having driven rotary take-up rollers to engage with and to advance the fabric being knit by the machine, the machine also having a rotary shaft upon which the so-advanced fabric is secured to and is rolled up upon, the machine also having means to drive the rollers and to secure the fabric to the rotary shaft, the safety device operating in combination with the machine in such manner as to automatically stop the machine in the event of failure to secure the fabric to the rotary shaft with a resultant failure to roll up the fabric upon the shaft.

5. A safety device as in claim 4 wherein the fabric swings outwardly of the machine in the event of failure to secure the fabric to the rotary shaft, and wherein the swinging fabric actuates the safety device to automatically stop the machine.

6. A safety device as in claim 5 wherein the safety device is provided with movable fingers to actuate the device, and wherein the swinging fabric engages with and moves the fingers thereby to actuate the safety device.

* * * * *